US007051626B1

(12) United States Patent
Chen et al.

(10) Patent No.: US 7,051,626 B1
(45) Date of Patent: May 30, 2006

(54) SCREWDRIVER HAVING RELEASE MECHANISM

(76) Inventors: Yi Ying Chen, No.82, Lane 59, Shinming St., Taiping City, Taichung County (TW) 41168; Siou Ru Chen, Floor 16-1, No. 362-20, Sec. 2, Songjhu Rd., Neighbor 1, Songmao Village, Beitun District, Taichung City (TW); Su Fen Lin, No. 138, Section 6, Chongde Rd., Beitun District, Taichung City (TW) 407

( * ) Notice: Subject to any disclaimer, the term of this patent is extended or adjusted under 35 U.S.C. 154(b) by 0 days.

(21) Appl. No.: 11/051,366

(22) Filed: Feb. 5, 2005

(51) Int. Cl.

| | |
|---|---|
| ***B25G 23/00*** | (2006.01) |
| ***B25G 1/08*** | (2006.01) |
| ***B25G 23/16*** | (2006.01) |
| ***B25G 1/00*** | (2006.01) |
| ***B25G 3/18*** | (2006.01) |

(52) U.S. Cl. ..... 81/438; 81/490; 81/177.4; 403/290

(58) Field of Classification Search ..... 81/438, 81/490, 492, 439, 177.4, 177.1, 177.2; 403/290, 403/326, 329
See application file for complete search history.

(56) References Cited

U.S. PATENT DOCUMENTS

| | | | | |
|---|---|---|---|---|
| 5,662,013 | A * | 9/1997 | Lin | 81/490 |
| 5,957,014 | A * | 9/1999 | Tseng et al. | 81/439 |
| 6,332,532 | B1 * | 12/2001 | Lee | 206/234 |

* cited by examiner

*Primary Examiner*—David B. Thomas
*Assistant Examiner*—Bryan Muller
(74) *Attorney, Agent, or Firm*—Charles E. Baxley

(57) ABSTRACT

A screwdriver includes a main body, an end cap, a holding seat, and a release mechanism. Thus, the holding seat and the end cap are removed from the main body easily and rapidly, thereby facilitating the user taking or placing the tips mounted in the mounting holes of the holding seat. In addition, the user only needs to press the push button of each of the two push button sets of the release mechanism so as to detach the holding seat and the end cap from the main body, thereby facilitating the user removing the holding seat and the end cap from the main body.

3 Claims, 6 Drawing Sheets

SCREWDRIVER HAVING RELEASE MECHANISM

BACKGROUND OF THE INVENTION

1. Field of the Invention

The present invention relates to a screwdriver, and more particularly to a screwdriver having a release mechanism.

2. Description of the Related Art

A conventional screwdriver comprises a main body having a first end formed with a receiving chamber to receive tips of different types and a second end provided with a connecting stem to connect the tips of different types, and an end cap closely fitted or screwed into the first end of the main body to close the receiving chamber of the main body. However, the user has to exert a larger force to remove the end cap from the main body or to rotate the end cap relative to the main body to unscrew the end cap from the main body so as to remove the end cap from the main body, thereby causing inconvenience to the user when taking or placing the tips.

SUMMARY OF THE INVENTION

The present invention is to mitigate and/or obviate the disadvantage of the conventional screwdriver.

The primary objective of the present invention is to provide a screwdriver having a release mechanism that is operated easily, rapidly and conveniently.

Another objective of the present invention is to provide a screwdriver, wherein the holding seat and the end cap are removed from the main body easily and rapidly, thereby facilitating the user taking or placing the tips mounted in the mounting holes of the holding seat.

A further objective of the present invention is to provide a screwdriver, wherein the user only needs to press the push button of each of the two push button sets of the release mechanism so as to detach the holding seat and the end cap from the main body, thereby facilitating the user removing the holding seat and the end cap from the main body.

In accordance with the present invention, there is provided a screwdriver, comprising a main body, an end cap mounted on the main body, and a release mechanism mounted between the main body and the end cap and including:

an axial spring axially mounted in the main body and biased between the main body and the end cap;

at least one push button set mounted on the main body and including a push button and a restoring spring;

at least one locking hook having a first end mounted on the end cap and a second end detachably locked in the main body and contacting with the push button of the at least one push button set;

wherein, the push button of the at least one push button set is movable to push and detach the second end of the at least one locking hook from the main body to release the end cap from the main body, so that the end cap is pushed by an elastic force of the axial spring to move outward relative to the main body.

Further benefits and advantages of the present invention will become apparent after a careful reading of the detailed description with appropriate reference to the accompanying drawings.

DETAILED DESCRIPTION OF THE INVENTION

Figure 1:
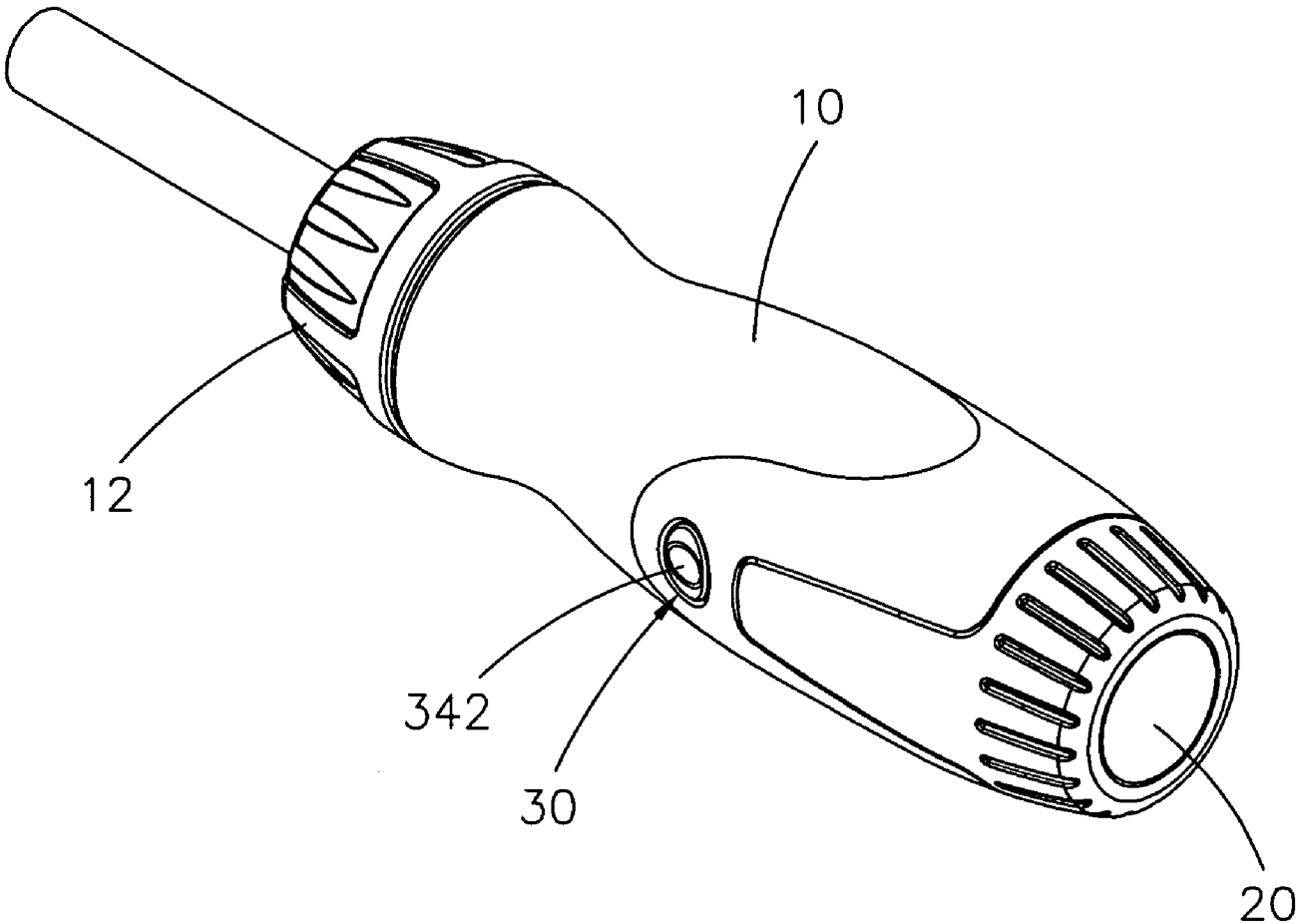
FIG. 1 is a perspective view of a screwdriver in accordance with the preferred embodiment of the present invention.
Figure 2:
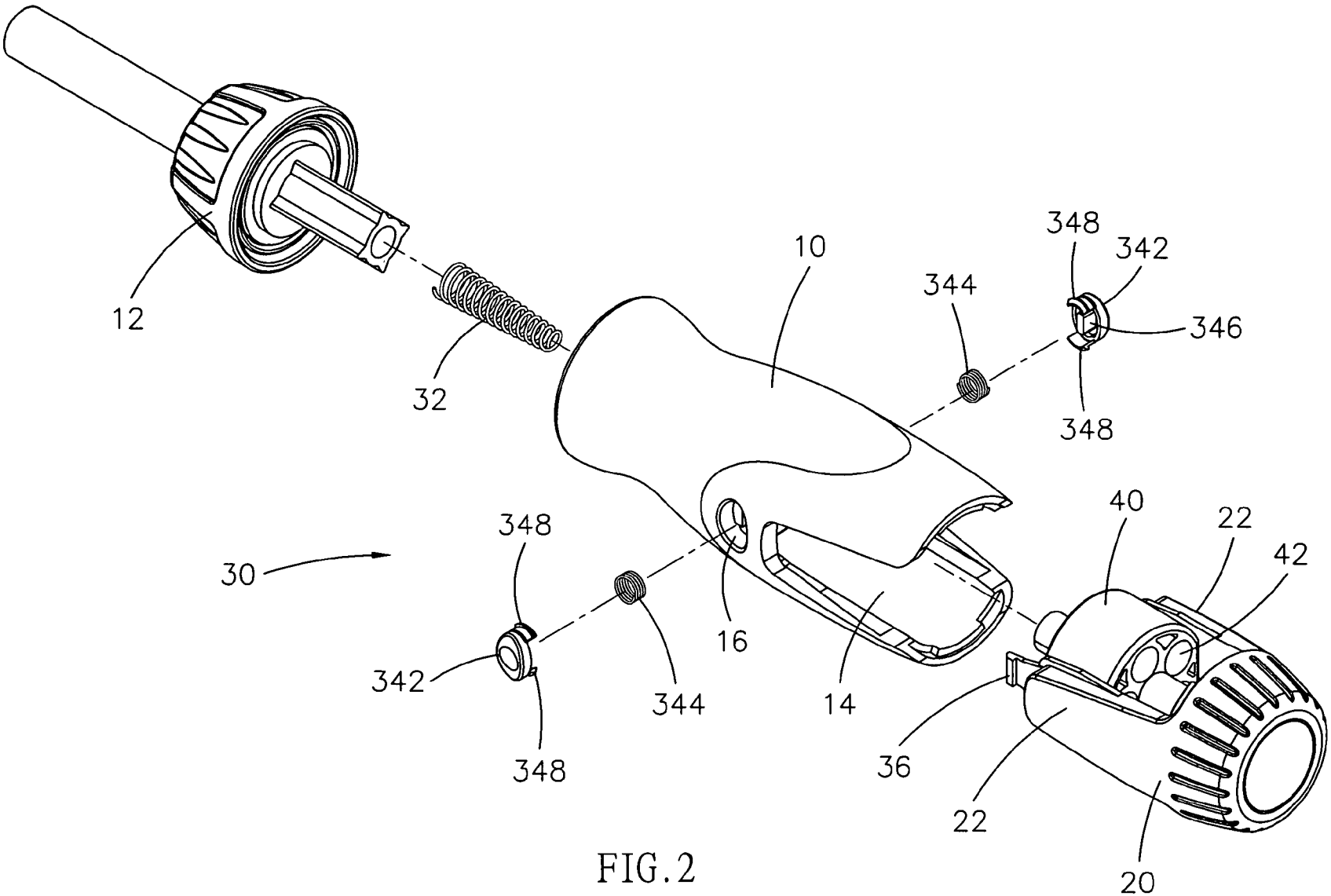
FIG. 2 is an exploded perspective view of the screwdriver as shown in FIG. 1.
Figure 3:
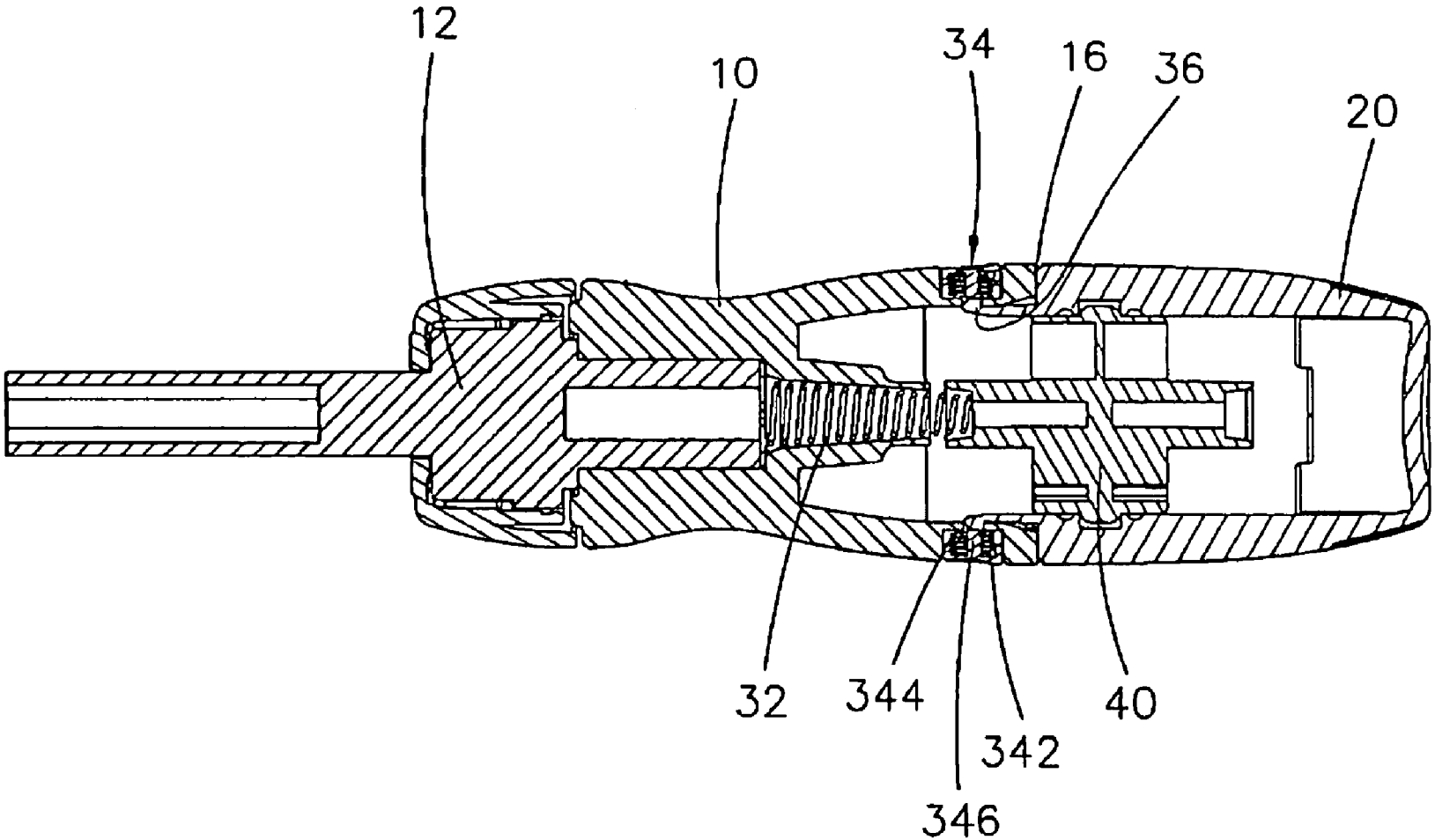
FIG. 3 is a plan cross-sectional view of the screwdriver as shown in FIG. 1.

Referring to the drawings and initially to FIGS. 1–3, a screwdriver in accordance with the preferred embodiment of the present invention comprises a main body 10, an end cap 20, a holding seat 40, and a release mechanism 30.

The main body 10 has a first end formed with a hollow receiving chamber 14 and a second end provided with a connecting stem 12 to connect tips 50 (see FIG. 6) of different types.

The end cap 20 is removably mounted on the first end of the main body 10 to close the receiving chamber 14 of the main body 10 and has two side walls 22 each received in the receiving chamber 14 of the main body 10.

The holding seat 40 is pivotally mounted on the end cap 20 between the two side walls 22 and received in the receiving chamber 14 of the main body 10. The holding seat 40 has a plurality of axially extended mounting holes 42 for mounting a plurality of tips 50 (see FIG. 6).

The release mechanism 30 includes an axial spring 32, two push button sets 34, and two opposite locking hooks 36.

The axial spring 32 is mounted in the main body 10 and has a first end urged on a bottom end of the connecting stem 12 and a second end urged on an end face of the holding seat 40.

Each of the two push button sets 34 is mounted on the main body 10 and includes a push button 342 and a restoring spring 344. The push button 342 has a cover shape. The push button 342 is movably mounted on the main body 10 and has a side face provided with a protruding push post 346. The push button 342 has a periphery provided with two opposite hook portions 348. The restoring spring 344 is mounted on an outside of the push post 346 and biased between the push button 342 and the main body 10.

The main body 10 has a surface formed with two opposite mounting holes 16 for mounting the two push button sets 34, and the restoring spring 344 is biased between a wall of the push button 342 and a wall of the respective mounting hole 16 of the main body 10.

Each of the two locking hooks 36 has a first end mounted on the end cap 20 and a second end extending into the respective mounting hole 16 of the main body 10 and contacting with the push post 346 of the respective push button 342 so that the end cap 20 is secured on the main body 10 by the two locking hooks 36.

Figure 4:
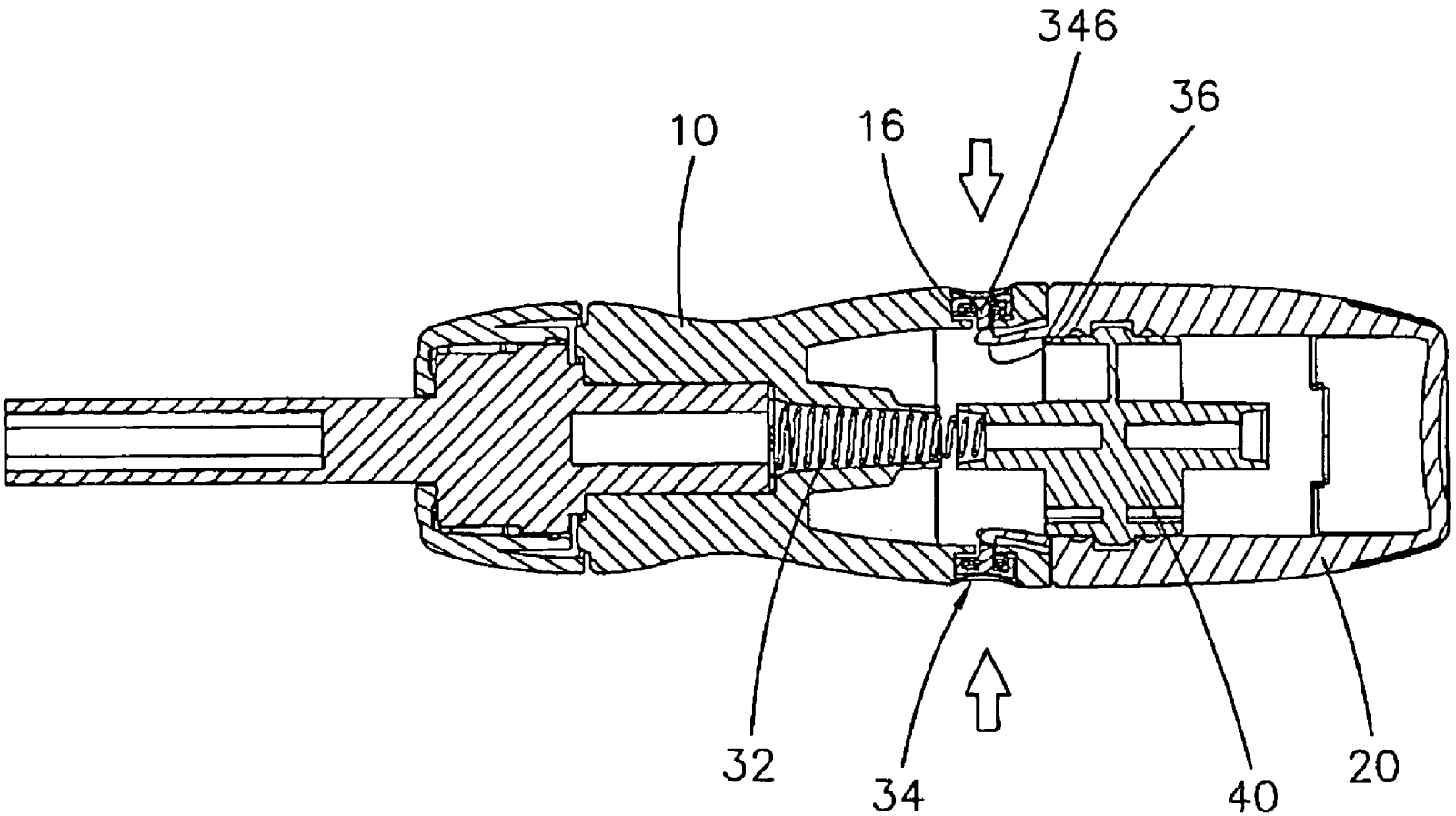
FIG. 4 is a schematic operational view of the screwdriver as shown in FIG. 3.
Figure 5:
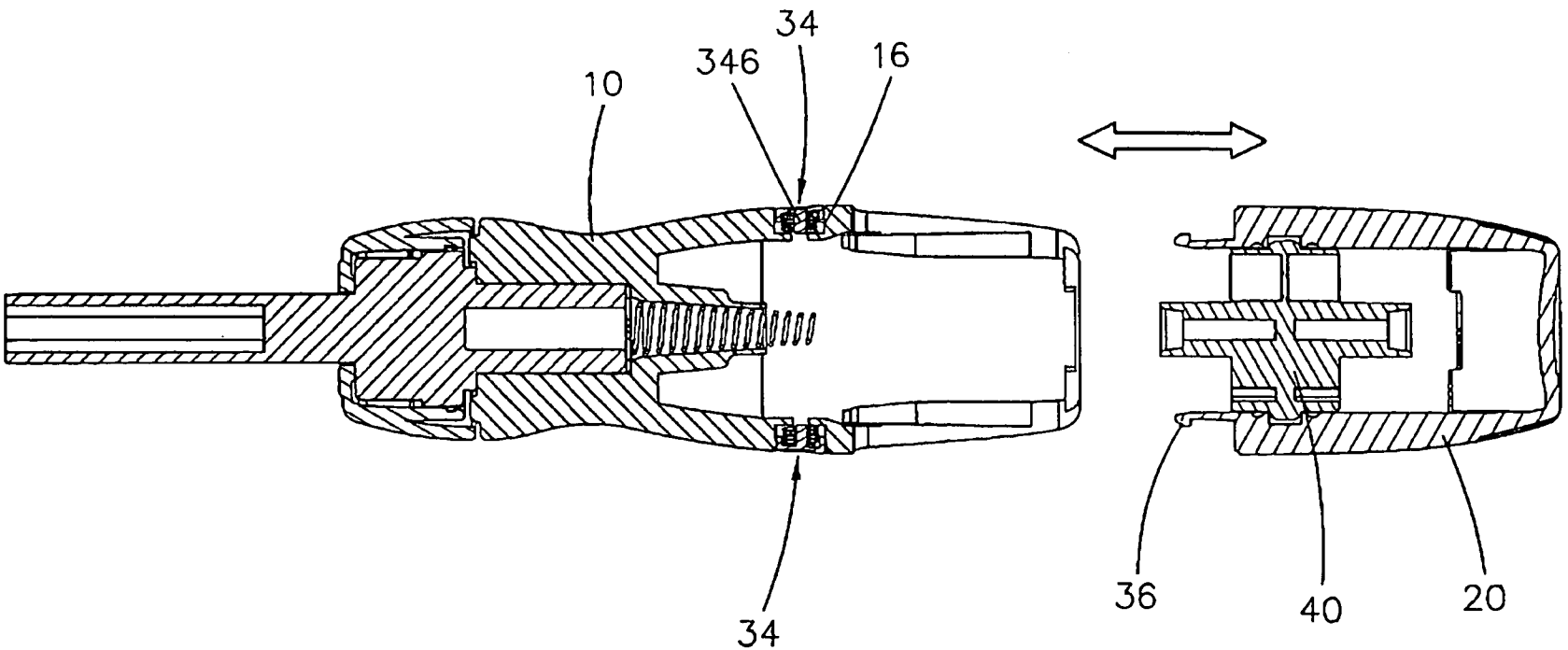
FIG. 5 is a schematic operational view of the screwdriver as shown in FIG. 4.

As shown in FIGS. 4 and 5, when the push button 342 of each of the two push button sets 34 are pressed inward by a user, the push post 346 is moved inward to push the second end of each of the two locking hooks 36 to detach each of the two locking hooks 36 from the respective mounting hole 16 of the main body 10, thereby releasing the end cap 20 from the main body 10, so that the holding seat 40 and the end cap 20 are pushed outward relative to the main body 10 by the restoring force of the axial spring 32, thereby removing the holding seat 40 and the end cap 20 from the main body 10 as shown in FIG. 5.

Figure 6:
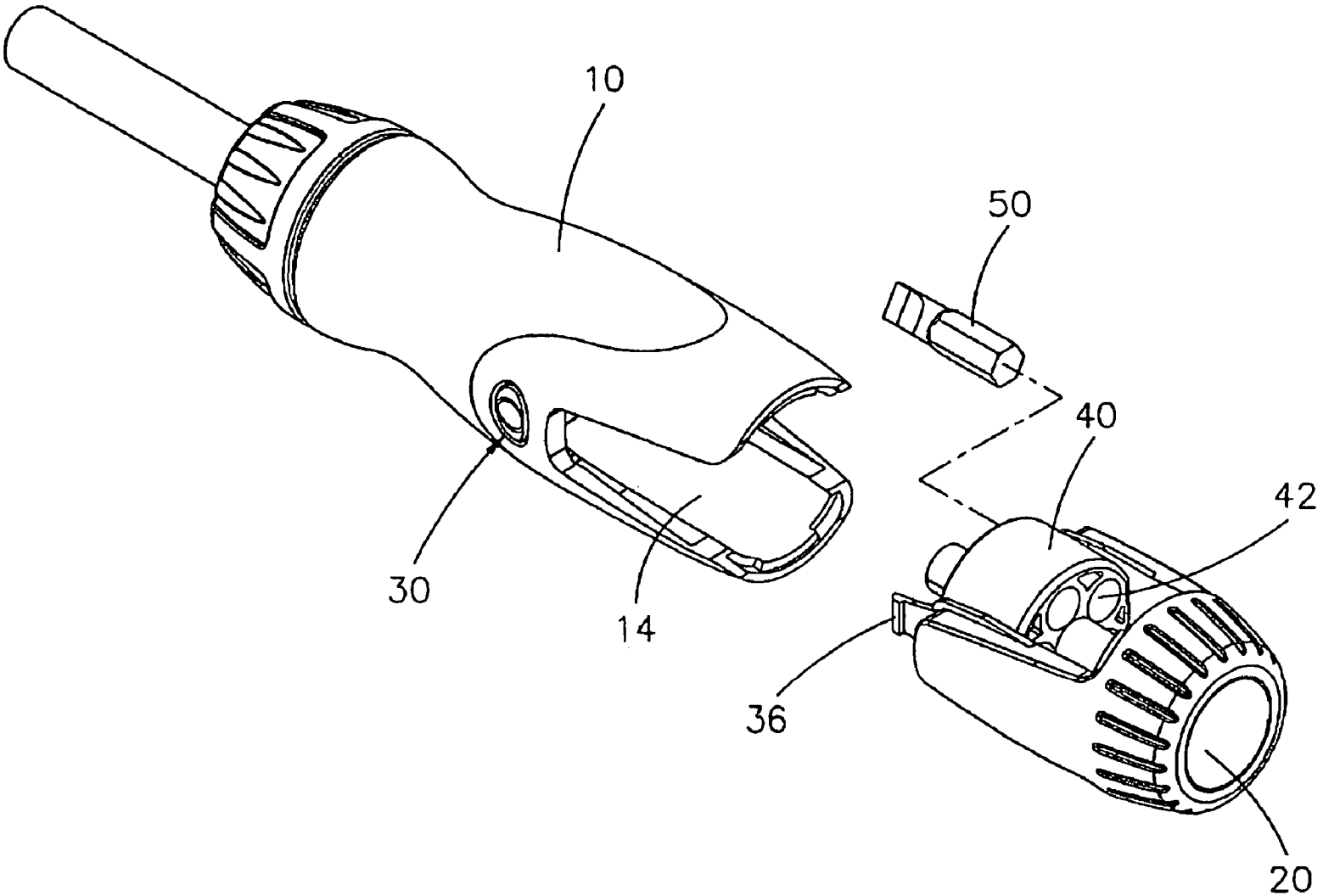
FIG. 6 is a schematic operational view of the screwdriver as shown in FIG. 1.

As shown in FIG. 6, the holding seat 40 is exposed outward from the end cap 20, so that the tips 50 mounted in the mounting holes 42 of the holding seat 40 are directed outward to facilitate the user taking or placing the tips 50.

Accordingly, the holding seat 40 and the end cap 20 are removed from the main body 10 easily, rapidly and conveniently, thereby facilitating the user taking or placing the tips 50 mounted in the mounting holes 42 of the holding seat 40. In addition, the user only needs to press the push button 342 of each of the two push button sets 34 of the release mechanism 30 so as to detach the holding seat 40 and the end cap 20 from the main body 10, thereby facilitating the user removing the holding seat 40 and the end cap 20 from the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A screwdriver, comprising a main body, an end cap mounted on the main body, and a release mechanism mounted between the main body and the end cap and including:

an axial spring axially mounted in the main body and biased between the main body and the end cap;

at least one push button set mounted on the main body and including a push button and a restoring spring;

at least one locking hook having a first end mounted on the end cap and a second end detachably locked in the main body and contacting with the push button of the at least one push button set;

wherein, the push button of the at least one push button set is movable to push and detach the second end of the at least one locking hook from the main body to release the end cap from the main body, so that the end cap is pushed by an elastic force of the axial spring to move outward relative to the main body.

2. The screwdriver in accordance with claim 1, wherein the push button has a protruding push post, the restoring spring is mounted on an outside of the push post and biased between the push button and the main body, and the second end of the at least one locking hook contacts with the push post of the push button.

3. The screwdriver in accordance with claim 1, wherein the main body has at least one mounting hole for mounting the at least one push button set, and the second end of the at least one locking hook is detachably locked in the at least one mounting hole of the main body.

* * * * *